US008329005B2

(12) United States Patent
Lee

(10) Patent No.: US 8,329,005 B2
(45) Date of Patent: Dec. 11, 2012

(54) BARREL PLATING APPARATUS

(75) Inventor: Jae Chan Lee, Busan (KR)

(73) Assignee: Samsung Electro-Mechanics Co., Ltd., Suwon, Gyunggi-do (KR)

( * ) Notice: Subject to any disclaimer, the term of this patent is extended or adjusted under 35 U.S.C. 154(b) by 356 days.

(21) Appl. No.: 12/717,721

(22) Filed: Mar. 4, 2010

(65) Prior Publication Data

US 2011/0114478 A1 May 19, 2011

(30) Foreign Application Priority Data

Nov. 13, 2009 (KR) ..... 10-2009-0109762

(51) Int. Cl.
*C25D 17/20* (2006.01)
*C25D 17/16* (2006.01)

(52) U.S. Cl. ..... 204/213; 204/201; 204/212; 204/229.8; 205/83; 205/143

(58) Field of Classification Search ..... 204/213, 204/229.8
See application file for complete search history.

(56) References Cited

U.S. PATENT DOCUMENTS 2,035,633 A * 3/1936 Bogle ..... 204/213
2,120,478 A * 6/1938 Amundsen ..... 204/213
3,844,923 A * 10/1974 Sandrock ..... 204/279
4,082,623 A * 4/1978 Musbach ..... 205/143
4,781,812 A * 11/1988 Lewellen, III ..... 204/279
6,432,282 B1 * 8/2002 Shamouilian et al. ..... 204/228.1
6,780,456 B2 * 8/2004 Kunishi et al. ..... 427/58
2005/0218001 A1 * 10/2005 You et al. ..... 205/89
2006/0103548 A1 * 5/2006 Borkowski et al. ..... 340/870.02

FOREIGN PATENT DOCUMENTS

JP 2001-355097 12/2001
JP 2002-249900 9/2002

OTHER PUBLICATIONS

Office Action from counterpart Korean Patent Application No. 10-2009-0109762, mailed Sep. 7, 2011, 4 pages.

* cited by examiner

*Primary Examiner* — Harry D Wilkins, III
*Assistant Examiner* — Bryan D. Ripa
(74) *Attorney, Agent, or Firm* — Blakely Sokoloff Taylor & Zafman LLP

(57) ABSTRACT

Disclosed herein is a barrel plating apparatus. The barrel plating apparatus includes a barrel plating tank filled with an electrolytic solution, a barrel container immersed in the electrolytic solution of the barrel plating tank and filled with chip parts and media, a power supply unit for supplying current to an anode part and a cathode part which transfer the current to the barrel container and the electrolytic solution of the barrel plating tank, a driving motor for rotating the barrel container, and a hall current sensor formed in at least one cathode rod of the cathode part, coming into direct contact with the chip parts, the hall current sensor measuring the current. Accordingly, in the barrel plating apparatus, the currents of respective cathode rods are measured by hall current sensors, and thus variations in plating thickness can be reduced.

5 Claims, 3 Drawing Sheets

BARREL PLATING APPARATUS

CROSS REFERENCE TO RELATED APPLICATION

This application claims the benefit of Korean Patent Application No. 10-2009-0109762, filed on Nov. 13, 2009, entitled "Barrel Plating Apparatus", which is hereby incorporated by reference in its entirety into this application.

BACKGROUND OF THE INVENTION

1. Technical Field

The present invention relates to a barrel plating apparatus.

2. Description of the Related Art

A process for generally manufacturing chip parts such as varistors, chip inductors, or Multi Layer Ceramic Capacitors (MLCCs) is described as follows.

1) A main material for a ceramic capacitor and a sub material which is an additive are caused to uniformly act on each other and are compounded. 2) The compounded ceramic material is mixed with a polymer binder and a solvent. 3) A slurry mixture is ripened into a stabilized state. 4) A polymer film (polyethylene terephthalate: PET) is coated with a predetermined thickness of the ripened ceramic slurry. 5) Molded tape is dried by passing it through a dry furnace, and 6) a desired capacity design pattern is printed on the tape using a silk screen, and thus internal electrodes are formed. 7) A ceramic sheet is dried in the dry furnace to maintain the paste shape of the printed internal electrodes. 8) The ceramic sheet is formed as multiple layers to obtain a desired capacity value, and 9) a multi-layer ceramic sheet is externally pressed with high pressure to maintain its layered state. 10) A layered ceramic bar is cut in the shape of chips having a predetermined size, and 11) a de-binder operation is performed to remove only binders included in the cut ceramic chips. 12) Chips, the de-binder operation of which has been completed, are heat-processed in a high-temperature electric furnace and are then plastically deformed. 13) The plastically deformed chips are polished so that sharp edges thereof are processed. 14) External electrodes are formed on external portions of the chips so that they are connected to the internal electrodes formed in the chips. 15) The chips, the internal and external electrodes of which have been terminated, are heat-processed, and are then fixed to the surface of the ceramic material. Further, 16) in order to render the external electrodes of the chips solderable, the external surfaces of the chips are plated with nickel and tin. 17) The parts of the chips, the plating of which has been completed, are sorted according to capacity deviation (J, K, M, Z), and the defects of insulation resistances (IR) are sorted. Thereafter, 18) the chip parts are taped using tape and packaged to enable the surface mounting of the parts.

As described above, since soldering cannot be directly performed on external electrodes which have been terminated during a process for manufacturing chip parts, the chip parts are sequentially plated with nickel (Ni) and Tin (Sn) as outermost electrodes so that soldering can be smoothly performed. A plating method used at that time is barrel plating.

Such barrel plating is a method of plating products such as chip parts having small shapes and sizes in bulk at one time, and the method is configured such that, as a barrel container immersed in a barrel plating tank rotates, products are frictionally polished while coming into contact with each other, so that the products come into contact with cathode rods and are plated while current is controlled, and thus considerable brightness occurs on the products.

However, the conventional barrel plating apparatus is problematic in that, while the barrel container rotates for a long period of time, chip parts and media separately gather at different locations in the barrel container, so that mixing efficiency deteriorates, differences in density occur, and the internal resistances of a plurality of cathode rods change to cause variations in current, thus resulting in variations in plating thickness.

Furthermore, since the conventional barrel plating apparatus is problematic in that, when a defect occurs in any one of a plurality of cathode rods coming into direct contact with chip parts, such a defect cannot be easily detected, and in that, when such a defect is neglected, variations in plating thickness become serious.

SUMMARY OF THE INVENTION

Accordingly, the present invention has been made keeping in mind the above problems occurring in the prior art, and the present invention is intended to provide a barrel plating apparatus, which detects the current flows of respective cathode rods, thus preventing variations in plating thickness.

Further, the present invention is intended to provide a barrel plating apparatus, which can easily detect a defective cathode rod, thus replacing the cathode rod.

In accordance with an aspect of the present invention, there is provided a barrel plating apparatus, comprising a barrel plating tank filled with an electrolytic solution, a barrel container immersed in the electrolytic solution of the barrel plating tank and filled with chip parts and media, a power supply unit for supplying current to an anode part and a cathode part which transfer the current to the barrel container and the electrolytic solution of the barrel plating tank, a driving motor for rotating the barrel container, and a hall current sensor formed in at least one cathode rod of the cathode part, coming into direct contact with the chip parts, the hall current sensor measuring the current.

In an embodiment, the cathode part comprises a center bar connected to the power supply unit through cranks and formed in parallel with an internal axis of the barrel container along the internal axis, and at least one cathode rod perpendicularly extending from the center bar to come into direct contact with the media, the cathode rod including a hall current sensor.

In an embodiment, the cathode rod comprises a cathode rod insulating cover formed on an outermost portion of the cathode rod, a cathode rod copper pipe formed in the cathode rod insulating cover and configured to allow the current to flow therethrough, a dangler formed at an end of the cathode rod and configured to come into direct contact with the media and the chip parts, and the hall current sensor formed in the cathode rod insulating cover and configured to enclose the cathode rod copper cover.

In an embodiment, the center bar comprises a center bar insulating cover formed on an outermost portion of the center bar, a center bar copper pipe formed in the center bar insulating cover and configured to allow the current to flow therethrough, and a sensor wire formed in the center bar insulating cover and connected to the hall current sensor.

In an embodiment, the cathode rod is implemented as a plurality of cathode rods.

In an embodiment, the sensor wire is formed to penetrate through the center bar copper pipe.

In an embodiment, the media are steel balls which are electrically conductive.

DESCRIPTION OF THE PREFERRED EMBODIMENTS

Figure 1:
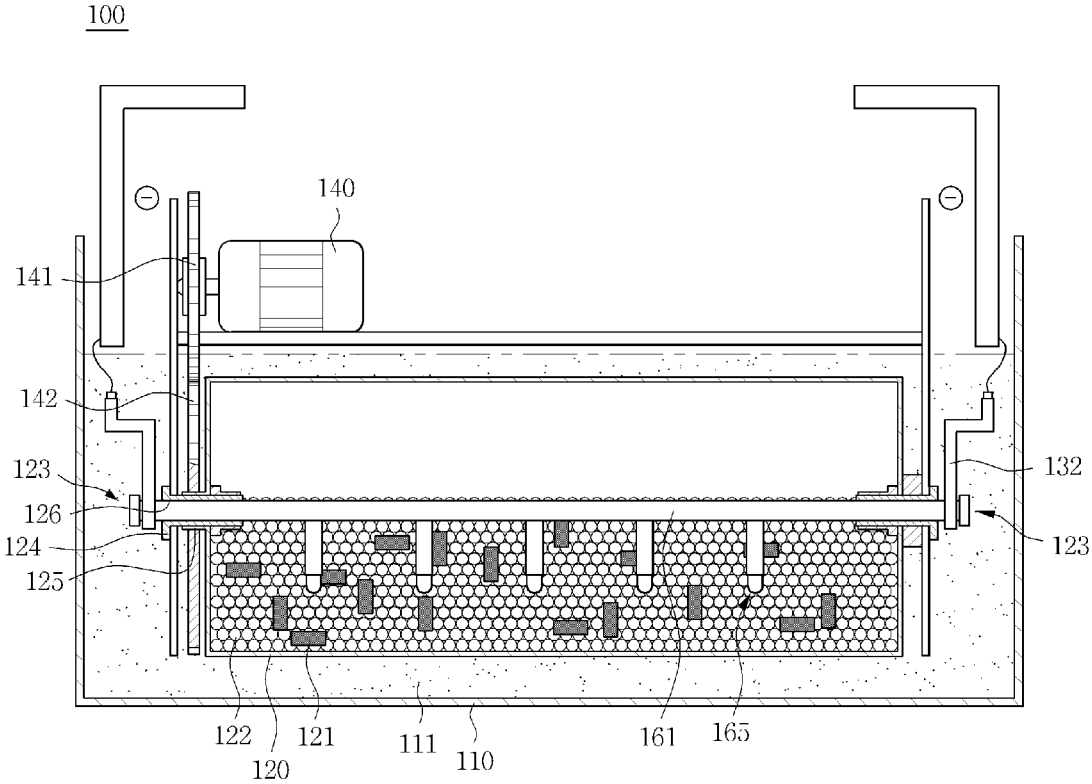
FIG. 1 is a front sectional view of a barrel plating apparatus according to an embodiment of the present invention.

Prior to giving the description, the terms and words used in the present specification and claims should not be interpreted as being limited to their typical meaning based on the dictionary definitions thereof, but should be interpreted to have the meaning and concept relevant to the technical spirit of the present invention, on the basis of the principle by which the inventor can suitably define the implications of terms in the way which best describes the invention.

The above and other objects, features and advantages of the present invention will be more clearly understood from the following detailed description taken in conjunction with the accompanying drawings. In the present specification, reference now should be made to the drawings, in which the same reference numerals are used throughout the different drawings to designate the same or similar components. Further, the terms "upper" or "lower" are used to distinguish one component from the other component, and the components of the present invention are not limited by the terms. Further, in the description of the present invention, if detailed descriptions of related well-known constructions or functions are determined to make the gist of the present invention unclear, the detailed descriptions will be omitted.

Hereinafter, embodiments of the present invention will be described in detail with reference to the attached drawings.

Figure 2:
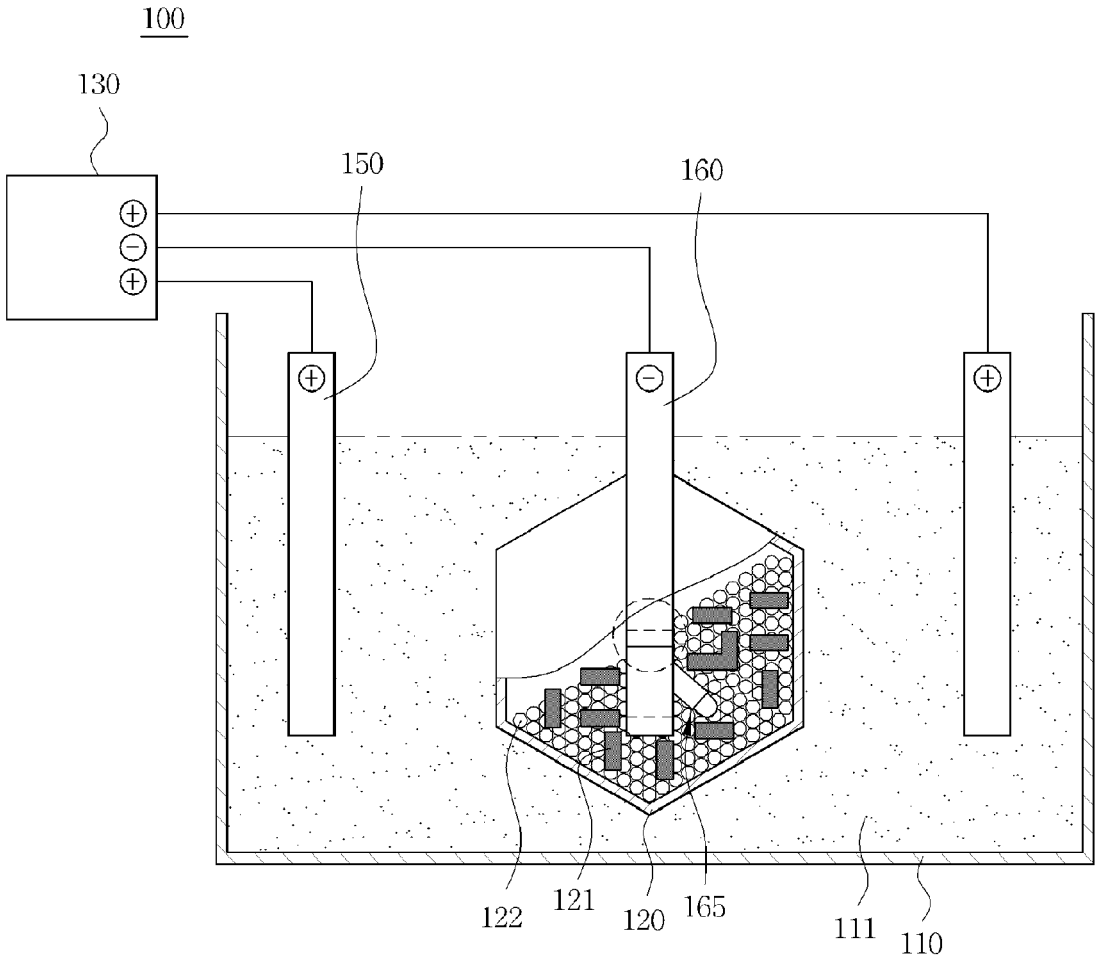
FIG. 2 is a side sectional view of the barrel plating apparatus of FIG. 1.
Figure 3:
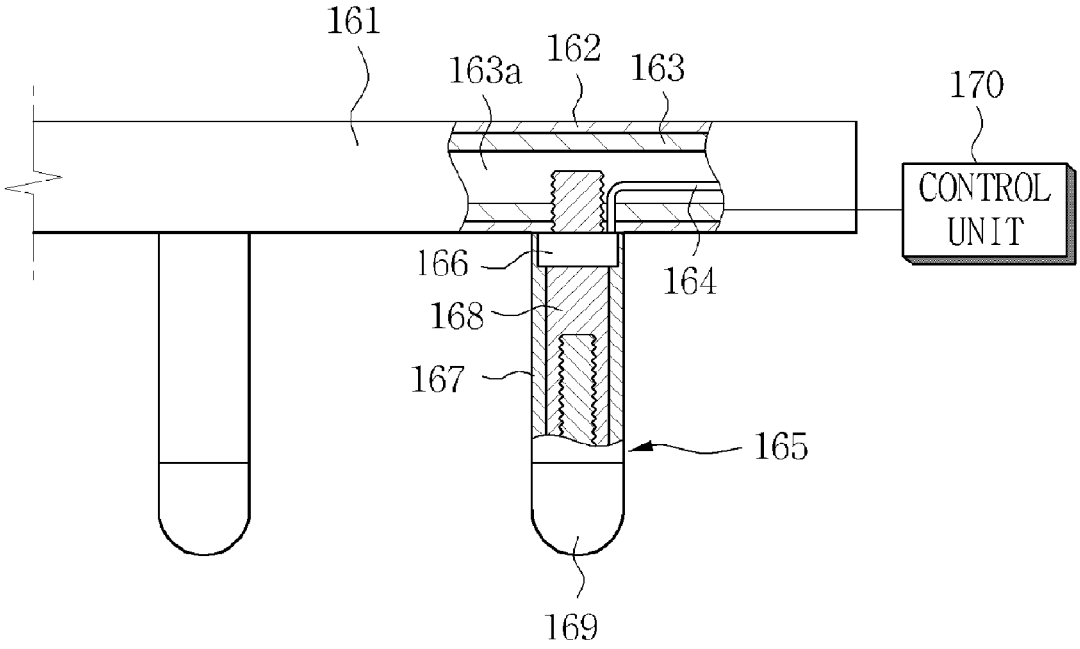
FIG. 3 is an enlarged view showing the cathode rod and center bar of the barrel plating apparatus of FIG. 1.

FIG. 1 is a front sectional view of a barrel plating apparatus 100 according to an embodiment of the present invention. FIG. 2 is a side sectional view of the barrel plating apparatus 100 of FIG. 1. FIG. 3 is an enlarged sectional view showing the cathode rod 165 and the center bar 161 of the barrel plating apparatus 100 of FIG. 1. The barrel plating apparatus 100 according to the present embodiment will be described with reference to FIGS. 1 to 3.

As shown in FIGS. 1 to 3, the barrel plating apparatus 100 according to the present embodiment includes a barrel plating tank 110, a barrel container 120, a power supply unit 130, and a driving motor 140, and is configured such that hall current sensors 166 are formed in cathode rods 165 of a cathode part 160, coming into direct contact with chip parts 121.

The barrel plating tank 110 is a component for accommodating other components of the barrel plating apparatus 100, and is filled with an electrolytic solution 111.

In this case, the barrel plating tank 110 is filled with the electrolytic solution 111, and may be formed in the shape of, for example, a hexahedral shape, one side of which is open. Further, the barrel container 120 and anode parts 150, as well as the electrolytic solution 111, are immersed in the barrel plating tank 110, so that the barrel plating tank 110 preferably has a sufficiently large size.

The barrel container 120 is a space which contains chip parts 121 and media 122 therein and in which plating is performed, and is a component which is immersed in the electrolytic solution 111 of the barrel plating tank 110.

That is, the barrel container 120 accommodates the chip parts 121 and the media 122, and thus preferably has the shape of a container in which a sufficient internal space is formed. Further, the center bar 161 and the cathode rods 165 of the cathode part 160, which will be described later, are accommodated in the barrel container 120, and then interact with the anode parts 150 immersed in the electrolytic solution 111 of the barrel plating tank 110, thus enabling plating layers to be formed on the chip parts 121 within the barrel container 120.

Meanwhile, the barrel container 120 is rotatable by the driving motor 140, which will be described later, only in one direction.

Rotation supporting units 123 are components provided at both left and right ends of the barrel container 120, and correspond to the axis of the barrel container 120.

In this case, the rotation supporting units 123 are equipped with hollow bushing pivots 124 which are fastening elements arranged on both left and right sides of the barrel container 120, and bushes 125 are provided on the external surfaces of the hollow bushing pivots 124. Further, the bushes 125 are assembled to both left and right side surfaces of the barrel container 120 so that they are integrated with the barrel container 120. The center bar 161 may be inserted through internal holes 126 of the hollow bushing pivots 124.

The driving motor 140 is a component for generating a turning force to rotate the barrel container 120.

Here, the turning force generated by the driving motor 140 is transferred to the barrel container 120 by the engagement of the driving gear 141 of the driving motor 140 with a passive gear 142 provided on any one of the rotation supporting units 123 of the barrel container 120, and the interaction attributable to the engagement.

The power supply unit 130 is a component for generating a current and transferring the current to the anode parts 150 and the cathode part 160.

Here, the anode parts 150 are connected to the power supply unit 130 and are immersed in the electrolytic solution 111 of the barrel plating tank 110. The cathode part 160 is connected to the power supply unit 130 and is configured to transfer the current into the barrel container 120.

The cathode part 160 is a component including the center bar 161 and the cathode rods 165, and is supplied with negative (−) power by the power supply unit 130.

Here, the center bar 161 is a component connected to the power supply unit 130 through cranks 132, and is formed lengthwise along the central axis of the barrel container 120. In detail, the center bar 161 may be formed to be parallel with the internal holes 126 of the hollow bushing pivots 124 of the rotation supporting units 123.

Further, as shown in FIG. 3, the center bar 161 may include a center bar insulating cover 162, a center bar copper pipe 163, and a sensor wire 164. The center bar insulating cover 162 is formed on the outermost portion of the center bar 161 and is configured to prevent current flowing through the center bar copper pipe 163 from leaking to the outside of the center bar 161. The center bar copper pipe 163 may be implemented as a conductor to enable current to flow therethrough. Further, the sensor wire 164 is connected to the hall current sensor 166 of each cathode rod 165, is capable of penetrating through the hollow space 163*a* of the center bar copper pipe 163, and is capable of receiving an electrical signal from the hall current sensor 166 and transferring the electrical signal to an external control unit 170.

Each cathode rod 165 is a component perpendicularly extending from the center bar 161 and comes into direct contact with the chip parts 121 or media 122 within the barrel container 120. The cathode rod 165 may include a cathode rod insulating cover 167, a cathode rod copper pipe 168, a dangler 169 and a hall current sensor 166. The cathode rod copper pipe 168 causes current received from the center bar copper pipe 163 to flow to the dangler 169. The cathode rod insulating cover 167 may function to isolate the cathode rod copper pipe 168 from the outside of the cathode rod 165. Further, the dangler 169, which is only a conductor portion of the cathode rod 165, exposed to the outside of the cathode rod 165, functions to transfer current flowing through the cathode rod copper pipe 168 to the media 122 or chip parts 121, and is formed at the end of the cathode rod 165. Meanwhile, a plurality of cathode rods 165 may be formed to be perpendicular to the center bar 161.

The hall current sensor 166 is a component formed within the cathode rod 165 and is configured to measure current flowing through the cathode rod copper pipe 168.

In this case, the hall current sensor 166 may be formed as a ring-shaped permanent magnet. Due to the interaction between the N pole and S pole of the permanent magnet, current may be measured by the hall current sensor 166, and may be transferred to the external control unit 170 through the sensor wire 164, and thus the control unit 170 may analyze the current.

The hall current sensor 166 may be formed to enclose the cathode rod copper pipe 168, and a separate circuit for amplifying an electrical signal output from the hall current sensor 166 may be further provided.

Meanwhile, as respective hall current sensors 166 measure currents flowing through the respective cathode rods 165, variations in the currents flowing through the cathode rods 165 can be detected, and the location of a defective cathode rod 165 can also to be determined. Therefore, the replacement of the defective cathode rod 165 can be easily performed. Further, each of the cathode rods 165 may be immersed in the electrolytic solution 111, and thus the hall current sensors 166 can measure currents flowing through the electrolytic solution 111. Further, the control unit 170 receives the current values, measured by the hall current sensors 166, through the sensor wire 164, and may display the current values in Ampere on a display device.

A method of performing plating using the barrel plating apparatus 100 having the above construction is described below. First, a door (not shown) provided on the external surface of the barrel container 120 is dissembled, so that both chip parts 121 and media 122, such as electrically conductive steel balls, are put into the barrel container 120. Next, the barrel container 120 is immersed in the electrolytic solution 111 of the barrel plating tank 110, and the power supply unit 130 generates currents while the barrel container 120 is rotated by the driving motor 140. Accordingly, currents are respectively supplied to the anode parts 150 and the cathode part 160, and the cathode rods 165 come into contact with the chip parts 121, and thus the chip parts 121 are plated. In this case, the chip parts 121 become cathodes and the media 122 become anodes. Accordingly, metal ions included in the electrolytic solution 111 are separated and are attached to the surfaces of the chip parts 121, which are cathodes, while the electrolytic solution 111 is electrolyzed, and thus plating layers are formed.

Meanwhile, the currents of respective cathode rods 165 are measured by the hall current sensors 166, and variations in the currents of the cathode rods 165 are detected, so that variations in the thickness of the plating of the chip parts 121 can be reduced. Further, a defective cathode rod 165 can be easily detected and replaced. Furthermore, the control unit 170 may receive variations in the currents of the cathode rods 165 through the sensor wire 164 connected to the hall current sensors 166, and may analyze the current variations and display the results of the analyzed current variations on a separate display device.

As described above, the barrel plating apparatus according to the present invention is advantageous in that hall current sensors are installed in respective cathode rods, and current values measured by the hall current sensors are transferred to a control unit through a sensor wire, thus detecting the current flows of the respective cathode rods and preventing variations in plating thickness.

Further, the present invention is advantageous because a defective cathode rod can be easily detected using hall current sensors and can be easily replaced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The simple modifications, additions and substations of the present invention are included in the scope of the present invention, and the detailed scope of the present invention will be clearly understood by the accompanying claims.

What is claimed is:

1. A barrel plating apparatus, comprising:

a barrel plating tank filled with an electrolytic solution;

a barrel container immersed in the electrolytic solution of the barrel plating tank and filled with chip parts and media;

a power supply unit for supplying current to an anode part and a cathode part which transfer the current to the barrel container and the electrolytic solution of the barrel plating tank;

a driving motor for rotating the barrel container wherein the cathode part comprises a center bar connected to the power supply unit through cranks and formed in parallel with an internal axis of the barrel container along the internal axis;

a cathode rod perpendicularly extending from the center bar to come into direct contact with the chip parts or the media; and a hall current sensor formed in the cathode rod to measure the current, and the center bar comprises a center bar insulating cover formed on an outermost portion of the center bar;

a center bar copper pipe formed in the center bar insulating cover and configured to allow the current to flow therethrough; and a sensor wire formed in the center bar insulating cover and connected to the hall current sensor.

2. The barrel plating apparatus as set forth in claim 1, wherein the cathode rod comprises:

a cathode rod insulating cover formed on an outermost portion of the cathode rod;

a cathode rod copper pipe formed in the cathode rod insulating cover and configured to allow the current to flow therethrough;

a dangler formed at an end of the cathode rod and configured to come into direct contact with the media and the chip parts; and the hall current sensor formed in the cathode rod insulating cover and configured to enclose the cathode rod copper pipe.

3. The barrel plating apparatus as set forth in claim 1, wherein the cathode rod is implemented as a plurality of cathode rods.

4. The barrel plating apparatus as set forth in claim 1, wherein the sensor wire is formed to penetrate through the center bar copper pipe.

5. The barrel plating apparatus as set forth in claim 1, wherein the media are steel balls which are electrically conductive.

* * * * *